US011136104B2

(12) United States Patent
Lee et al.

(10) Patent No.: US 11,136,104 B2
(45) Date of Patent: Oct. 5, 2021

(54) SHIP

(71) Applicant: DAEWOO SHIPBUILDING & MARINE ENGINEERING CO., LTD., Geoje-si (KR)

(72) Inventors: Seung Chul Lee, Seoul (KR); Yoon Kee Kim, Gunpo-si (KR)

(73) Assignee: DAEWOO SHIPBUILDING & MARINE ENGINEERING CO., LTD., Geoje-si (KR)

( * ) Notice: Subject to any disclaimer, the term of this patent is extended or adjusted under 35 U.S.C. 154(b) by 114 days.

(21) Appl. No.: 16/090,077

(22) PCT Filed: Oct. 21, 2016

(86) PCT No.: PCT/KR2016/011913
§ 371 (c)(1),
(2) Date: Sep. 28, 2018

(87) PCT Pub. No.: WO2017/171172
PCT Pub. Date: Oct. 5, 2017

(65) Prior Publication Data

US 2019/0112022 A1 Apr. 18, 2019

(30) Foreign Application Priority Data

Mar. 31, 2016 (KR) ..... 10-2016-0039516

(51) Int. Cl.
*B63J 2/14* (2006.01)
*B63B 25/16* (2006.01)
(Continued)

(52) U.S. Cl.
CPC ..... *B63J 2/14* (2013.01); *B63B 25/16* (2013.01); *F02M 21/0215* (2013.01); *F17C 6/00* (2013.01);
(Continued)

(58) Field of Classification Search
CPC ..... B63K 25/16; F02M 21/0215; F17C 6/00; F17C 9/0204; F17C 2221/033;
(Continued)

(56) References Cited

U.S. PATENT DOCUMENTS 4,249,387 A 2/1981 Crowley
4,727,723 A 3/1988 Durr
(Continued)

FOREIGN PATENT DOCUMENTS

CN 10484681 A 8/2015
CN 204963420 U 1/2016
(Continued)

OTHER PUBLICATIONS

International Search Report of corresponding Patent Application No. PCT/KR2016/011913—6 pages (dated Jan. 6, 2017).
(Continued)

*Primary Examiner* — Joel M Attey
(74) *Attorney, Agent, or Firm* — K&L Gates LLP

(57) ABSTRACT

A ship comprises: a tank; a multistage compressor for compressing a boil-off gas discharged from a storage tank and comprising a plurality of compression cylinders; a first heat exchanger for heat exchanging a fluid, which has been compressed by the multistage compressor, with the boil-off gas discharged from the storage tank and thus cooling the same; a first decompressing device for expanding a flow ("flow a1") partially branched from the flow ("flow a") that has been cooled by the first heat exchanger; a third heat exchanger for heat exchanging, by "flow a1" which has been expanded by the first decompressing device as a refrigerant, the remaining flow ("flow a2") of "flow a" after excluding "flow a1" that has been branched and thus cooling the same; and a second decompressing device for expanding "flow a2" which has been cooled by the third heat exchanger.

2 Claims, 1 Drawing Sheet

(51) Int. Cl.

| | |
|---|---|
| ***F17C 6/00*** | (2006.01) |
| ***F17C 9/04*** | (2006.01) |
| ***F17C 9/02*** | (2006.01) |
| ***F02M 21/02*** | (2006.01) |

(52) U.S. Cl.

CPC ..... *F17C 9/02* (2013.01); *F17C 9/04* (2013.01); *F17C 2221/033* (2013.01); *F17C 2227/0164* (2013.01); *F17C 2227/0185* (2013.01); *F17C 2227/0339* (2013.01); *F17C 2227/0348* (2013.01); *F17C 2227/0358* (2013.01); *F17C 2265/033* (2013.01); *F17C 2265/034* (2013.01); *F17C 2265/037* (2013.01); *F17C 2265/038* (2013.01); *F17C 2265/066* (2013.01); *F17C 2270/0105* (2013.01)

(58) Field of Classification Search

CPC ..... F17C 2227/0164; F17C 2227/0185; F17C 2227/0339; F17C 2227/0348; F17C 2227/0358; F17C 2265/033; F17C 2265/037; F17C 2265/038; F17C 2265/066; F17C 2265/03; F17C 1/002; F17C 3/025; F17C 9/02; F17C 9/04; B63B 25/16

USPC ..... 62/613

See application file for complete search history.

(56) References Cited

U.S. PATENT DOCUMENTS

| | | | | |
|---|---|---|---|---|
| 6,898,949 | B2 | 5/2005 | Paradowski | |
| 2016/0356424 | A1* | 12/2016 | Lee | F02M 21/0224 |

FOREIGN PATENT DOCUMENTS

| | | | |
|---|---|---|---|
| JP | 2014-511985 | A | 5/2014 |
| JP | 2014-514513 | A | 6/2014 |
| JP | 2014522476 | A | 9/2014 |
| JP | 2015505941 | A | 2/2015 |
| KR | 10-1334002 | B1 | 11/2013 |
| KR | 10-1459962 | B1 | 11/2014 |
| KR | 10-1496577 | B1 | 2/2015 |
| KR | 101496577 | B1 | 2/2015 |
| KR | 10-1519541 | B1 | 5/2015 |
| KR | 10-1557571 | B1 | 10/2015 |
| WO | 2015/130122 | A1 | 9/2015 |

OTHER PUBLICATIONS

Extended European Search Report of corresponding European Patent Application No. 16897185.1—7 pages (dated Oct. 31, 2019).

Witt, "Onboard Reliquefaction of LNG Boil-off", 979 Trans. of Inst. of Marine Eng. vol. 92, No. 2—14 pages (1980).

Office Action of corresponding Singaporean Patent Application No. 11201808238X—6 pages (dated Jan. 17, 2020).

Office Action and Search Report of corresponding Chinese Patent Application No. 201680084260.9—20 pages (dated Jun. 8, 2020).

Witt, "Onboard Reliquefaction of LNG Boil-off", Trans. I. Mar. E. (TM), vol. 92, Paper 2—14 pages (1980).

Communication for EP 16 897 193.5 dated Nov. 2, 2020—4 pages.

Office Action for JP 2018-549915 dated Sep. 14, 2020.

K. Witt: "Onboard Reliquefaction of LNG Boil-off", and Trans. I. Marine Eng. vol. 92, and Part 1, pp. 22-35, ISSN 0309-3948.

J. Romero Gomez et al., "On board LNG relique-faction technology: a comparative study", and Polish Maritime Research (wave), Gdansk University of Technology, 2013, and vol. 21, p. 77-88, DOI:10.2478-/pomr-2014-0011, ISSN 2083-7429.

Written Opinion of SG 11201808238X dated Dec. 2, 2020—6 pages.

* cited by examiner

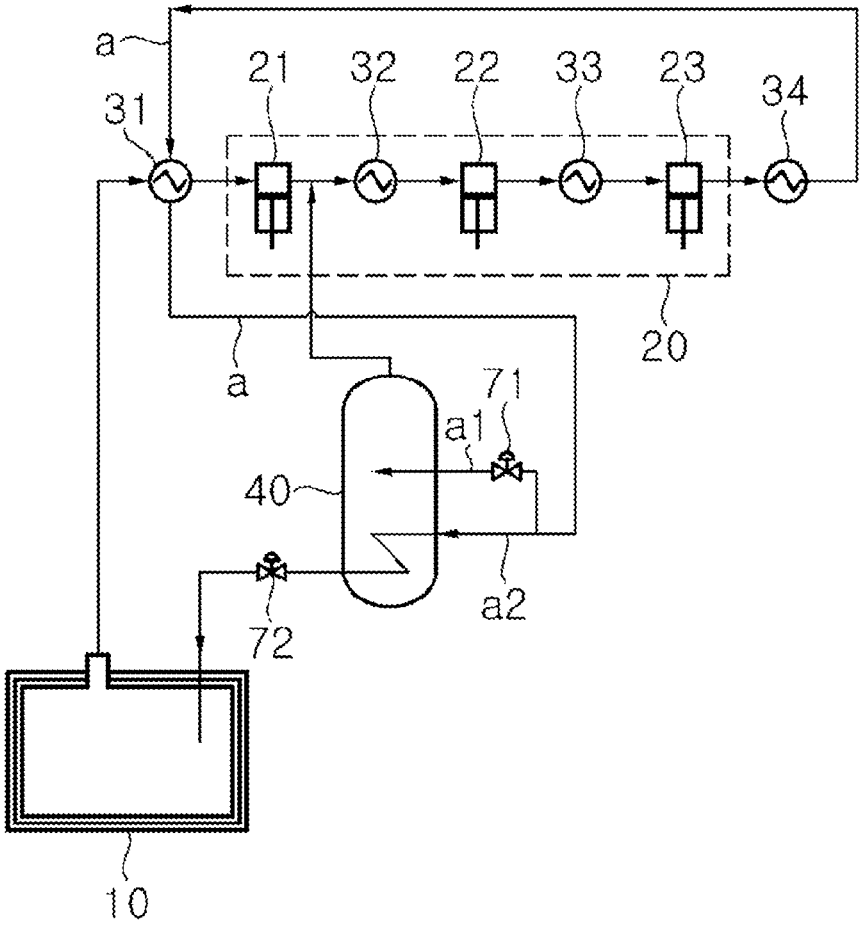
a
21
32
22
33
23
34
31
20
a
71
a1
40
a2
72
10

SHIP

TECHNICAL FIELD

The present invention relates to a ship and, more particularly, to a ship including a system which reliquefies boil-off gas generated in a storage tank using boil-off gas itself as a refrigerant.

BACKGROUND ART

Even when a liquefied gas storage tank is insulated, there is a limit to completely block external heat. Thus, liquefied gas is continuously vaporized in the storage tank by heat transferred into the storage tank. Liquefied gas vaporized in the storage tank is referred to as boil-off gas (BOG).

If the pressure in the storage tank exceeds a predetermined safe pressure due to generation of boil-off gas, the boil-off gas is discharged from the storage tank through a safety valve. The boil-off gas discharged from the storage tank is used as fuel for a ship, or is reliquefied and returned to the storage tank.

DISCLOSURE

Technical Problem

Typically, a boil-off gas reliquefaction system employs a refrigeration cycle for reliquefaction of boil-off gas through cooling. Cooling of boil-off gas is performed through heat exchange with a refrigerant and a partial reliquefaction system (PRS) using boil-off gas itself as a refrigerant is used in the art.

Embodiments of the present invention provide a ship including an improved partial reliquefaction system capable of more efficiently reliquefying boil-off gas.

Technical Solution

In accordance with one aspect of the present invention, there is provided a ship having a liquefied gas storage tank, the ship including: a multistage compressor including a plurality of compression cylinders to compress boil-off gas discharged from the storage tank; a first heat exchanger cooling the fluid compressed by the multistage compressor by subjecting the fluid to heat exchange with the boil-off gas discharged from the storage tank; a first decompressor expanding one (hereinafter referred to as "flow a1") of two flows branching off of the fluid cooled by the first heat exchanger (hereinafter referred to as "flow a"); a third heat exchanger cooling the other flow (hereinafter referred to as "flow a2") of the two flows by subjecting the flow a2 to heat exchange with the flow a1 expanded by the first decompressor to be used as a refrigerant; and a second decompressor expanding the flow a2 cooled by the third heat exchanger.

The fluid expanded by the first decompressor and having been used as a refrigerant in the third heat exchanger may be supplied to the multistage compressor.

The first heat exchanger may be disposed upstream of the multistage compressor.

The multistage compressor may include a plurality of coolers regularly arranged downstream of the compression cylinders respectively.

The ship may further include a second heat exchanger cooling the fluid compressed by the multistage compressor by subjecting the fluid to heat exchange before the fluid is supplied to the first heat exchanger.

In accordance with another aspect of the present invention, there is provided a boil-off gas reliquefaction method used in a ship having a liquefied gas storage tank, the boil-off gas reliquefaction method including: 1) compressing boil-off gas discharged from the storage tank and cooling, by a first heat exchanger, the compressed boil-off gas through a heat exchange process using the boil-off gas discharged from the storage tank as a refrigerant; 2) dividing the fluid cooled by the first heat exchanger in step 1) into two flows; 3) expanding one of the two flows divided in step 2) and using the one flow as a refrigerant in a third heat exchanger; 4) cooling, by the third heat exchanger, the other flow of the two flows divided in step 3); and 5) expanding and reliquefying the fluid cooled by the third heat exchanger in step 4), wherein the fluid expanded in step 3) and having been used as a refrigerant in the third heat exchanger is compressed in step 1).

The fluid compressed in step 1) may be cooled by a second heat exchanger before being supplied to the first heat exchanger to be cooled.

Advantageous Effects

According to the present invention, a refrigerant for reliquefaction of boil-off gas can be diversified, thereby reducing the amount of boil-off gas branching off upstream of a heat exchanger to be used as the refrigerant.

Since the boil-off gas branching off to be used as a refrigerant is subjected to a compression process in a multistage compressor, reduction in the amount of boil-off gas can also cause reduction in the amount of boil-off gas compressed by the multistage compressor, whereby the same level of reliquefaction efficiency can be achieved with lower power consumption of the multistage compressor.

DESCRIPTION OF DRAWINGS

FIG. 1 is a schematic block diagram of a partial reliquefaction system used in a ship according to an exemplary embodiment of the present invention.

BEST MODE

Hereinafter, embodiments of the present invention will be described in detail with reference to the accompanying drawings. A ship according to the present invention may be widely used in applications such as a ship equipped with an engine fueled by natural gas and a ship including a liquefied gas storage tank. It should be understood that the following embodiments can be modified in various ways and do not limit the scope of the present invention.

Systems for treatment of boil-off gas according to the present invention as described below may be used in all kinds of ships and offshore structures including a storage tank capable of storing liquid cargo or liquefied gas at low temperature, that is, ships such as liquefied gas carriers and offshore structures such as FPSOs or FSRUs.

In addition, a fluid in each line according to the invention may be in a liquid phase, in a gas/liquid mixed phase, in a gas phase, or in a supercritical fluid phase depending on system operation conditions.

FIG. 1 is a schematic block diagram of a partial reliquefaction system applied to a ship according to an exemplary embodiment of the present invention.

Referring to FIG. 1, a ship according to this embodiment includes: a first heat exchanger 31; a multistage compressor 20 including a plurality of compression cylinders 21, 22, 23 and a plurality of coolers 32, 33; a third heat exchanger 40; a first decompressor 71; and a second decompressor 72.

Liquefied gas stored in a storage tank 10 of the ship according to this embodiment may have a boiling point of higher than −110° C. at 1 atm. In addition, the liquefied gas stored in the storage tank 10 may be liquefied petroleum gas (LPG) or may include multiple components such as methane, ethane, and heavy hydrocarbons.

In this embodiment, the multistage compressor 20 compresses boil-off gas discharged from the storage tank 10. The multistage compressor 20 may include a plurality of compression cylinders, for example, three compression cylinders 21, 22, 23, as shown in FIG. 1. In addition, the multistage compressor 20 may include a plurality of coolers. The plurality of coolers is regularly arranged between the plurality of compression cylinders to cool the boil-off gas increased in both pressure and temperature in the process of being compressed by the compression cylinders. In FIG. 1, a first cooler 32 is disposed between a first compression cylinder 21 and a second compression cylinder 22 and a second cooler 33 is disposed between the second compression cylinder 22 and a third compression cylinder 23.

The fluid subjected to multistage compression and cooling in the multistage compressor 20 is supplied to the first heat exchanger 31 disposed upstream of the multistage compressor 20. The first heat exchanger 31 cools the fluid having passed through the multistage compressor 20 (flow a) through a self-heat exchange process using the boil-off gas discharged from the storage tank 10 as a refrigerant. In the term "self-heat exchange", "self-" means that boil-off gas itself is used as a refrigerant for heat exchange. The boil-off gas discharged from the storage tank 10 and having been used as a refrigerant in the first heat exchanger 31 is supplied to the multistage compressor 20, and the fluid passing through the multistage compressor 20 and having been cooled by the first heat exchanger 31 (flow a) is supplied to the third heat exchanger 40.

In this embodiment, the fluid that having passed through the multistage compressor 20 may be cooled by a second heat exchanger 34 before being supplied to the first heat exchanger 31. The second heat exchanger 34 may use a separate refrigerant such as seawater as a refrigerant for cooling boil-off gas. Alternatively, the second heat exchanger 34 may be configured to use boil-off gas itself as the refrigerant, like the first heat exchanger 31.

A pressure at which the fluid having been subjected to multistage compression in the multistage compressor 20 is discharged from the multistage compressor 20 (hereinafter, "discharge pressure of the multistage compressor") may be determined based on the temperature of the fluid discharged from the second heat exchanger 34 after being cooled by the second heat exchanger 34. Preferably, the discharge pressure of the multistage compressor 20 is determined by a saturated liquid pressure corresponding to the temperature of the fluid discharged from the second heat exchanger 34 after being cooled by the second heat exchanger 34. That is, when the liquefied gas is LPG, the discharge pressure of the multistage compressor 20 may be determined by a pressure at which at least a portion of the fluid having passed through the second heat exchanger 34 becomes a saturated liquid. In addition, a pressure at which the fluid having passed through each compression stage is discharged from a corresponding compression cylinder may be determined by performance of the corresponding compression cylinder.

The fluid having passed through the multistage compressor 20 and the first heat exchanger 31 (flow a) is divided into two flows a1, a2 upstream of the third heat exchanger 40. The flow a1 is expanded by the first decompressor 71 to be reduced in temperature and is then used as a refrigerant in the third heat exchanger 40 and the flow a2 is subjected to heat exchange in the third heat exchanger 40 to be cooled and is then expanded by the second decompressor 72 to be partially or entirely reliquefied. The fluid having been partially or entirely reliquefied by the second decompressor 72 is supplied to the storage tank 10, and the fluid having been used as a refrigerant in the third heat exchanger 40 (flow a1) is supplied to the multistage compressor 20.

Depending on the degree of being expanded by the first decompressor 71, the fluid used as a refrigerant in the third heat exchanger 40 and having been supplied to the multistage compressor 20 may join a fluid having a pressure similar to that of the foregoing fluid, among fluids to be subjected to multistage compression in the multistage compressor 20. In FIG. 1, the fluid used as a refrigerant in the third heat exchanger 40 and having been supplied to the multistage compressor 20 is shown as joining another flow of boil-off gas between the first compression cylinder 21 and the first cooler 32.

In this embodiment, each of the first decompressor 71 and the second decompressor 72 may be an expansion valve such as a Joule-Thomson valve or may be an expander depending on system configuration. In this embodiment, the first heat exchanger 31 may be an economizer and the third heat exchanger 40 may be an intercooler.

For example, when the liquefied gas is LPG, the fluid having been compressed by the multistage compressor 20 passes through the second heat exchanger 34 to be cooled. Here, at least a portion of the fluid may be liquefied by the second heat exchanger 34 and be supercooled by the first heat exchanger 31. In addition, the fluid having been supercooled by the first heat exchanger 31 is divided into the flow a1 and the flow a2, wherein the flow a1 is used as a refrigerant in the third heat exchanger 40 after being expanded by the first decompressor 71 and the flow a2 is secondarily supercooled by the third heat exchanger 40 using the flow a1 having been subjected to expansion as a refrigerant. The flow a2 having been supercooled by the third heat exchanger 40 is expanded by the second decompressor 72 and then returned in a liquid phase to the storage tank 10.

According to the present invention, in addition to a process of reliquefying boil-off gas through compression in the multistage compressor 20, cooling in the third heat exchanger 40, and expansion in the second decompressor 72, the fluid having been compressed by the multistage compressor 20 is cooled by the first heat exchanger 31, whereby the temperature of the fluid supplied to the third heat exchanger 40 (flow a) can be further reduced. As a result, the same level of reliquefaction efficiency can be achieved with a lower amount of boil-off gas branching off to be used as a refrigerant (flow a1). In addition, since the fluid having been used a refrigerant in the third heat exchanger 40 (flow a1) is compressed by the multistage compressor 20, energy consumption of the multistage compressor 20 can be reduced by reducing the amount of the fluid used as a refrigerant in the third heat exchanger 40 (flow a1). In other words, with the first heat exchanger 31, the partial reliquefaction system according to the present invention can reduce the amount of the fluid used as a refrigerant in the third heat exchanger 40 (flow a1), thereby reducing energy consumption of the multistage compressor 20 while achieving almost the same level of reliquefaction efficiency.

Although some embodiments have been described, it will be apparent to those skilled in the art that these embodiments are given by way of illustration only, and that various modifications, changes, alterations, and equivalent embodiments can be made without departing from the spirit and scope of the invention.

The invention claimed is:

1. A boil-off gas reliquefaction method used in a ship having a liquefied gas storage tank containing liquefied gas with a boiling point of higher than −110° C. at 1 atm, the boil-off gas reliquefaction method comprising:

compressing boil-off gas, by a multi-stage compressor, discharged from the storage tank;

cooling and liquefying, by a first heat exchanger, at least a portion of the compressed boil-off gas, and supercooling, by a second heat exchanger, the liquefied portion of the compressed boil-off gas through a heat exchange process using the boil-off gas discharged from the storage tank as a refrigerant;

dividing the fluid supercooled by the second heat exchanger into at least two flows comprising a first flow and a second flow;

expanding, by a first decompressor, the first flow and using the expanded first flow as a refrigerant in a third heat exchanger;

cooling, by the third heat exchanger, the second flow; and expanding and reliquefying, by a second decompressor, the second flow cooled by the third heat exchanger, wherein the first flow expanded by the first decompressor and having been used as a refrigerant in the third heat exchanger is compressed by the multi-stage compressor.

2. The boil-off gas reliquefaction method according to claim 1, wherein the boil-off gas compressed by the multi-stage compressor is cooled by the first heat exchanger before being supplied to the second heat exchanger.

* * * * *